United States Patent [19]

Greenspan

[11] Patent Number: 4,459,059

[45] Date of Patent: Jul. 10, 1984

[54] SLIDING CAP WITH FRICTIONAL ENGAGEMENT

[76] Inventor: Donald J. Greenspan, 235 Pavilion Ave., Riverside, N.J. 08075

[21] Appl. No.: 365,112

[22] Filed: Apr. 5, 1982

Related U.S. Application Data

[63] Continuation-in-part of Ser. No. 282,299, Jul. 10, 1981, abandoned.

[51] Int. Cl.[3] ..... B43K 9/00; B43K 23/00

[52] U.S. Cl. ..... 401/117; 401/91; 401/202; 401/213; 401/243; 24/11 R; 24/11 F

[58] Field of Search ..... 401/117, 91; 24/11

[56] References Cited

U.S. PATENT DOCUMENTS

| | | | |
|---|---|---|---|
| 895,463 | 8/1908 | Houston | 401/117 |
| 928,312 | 7/1909 | Lloyd | 401/117 |
| 971,797 | 10/1910 | Smythe | 401/91 |
| 1,466,203 | 8/1923 | Burnett | 24/11 P |
| 1,646,742 | 10/1927 | Becker | 24/11 P |
| 1,680,601 | 8/1928 | Elliott | 24/11 F |
| 1,720,471 | 7/1929 | Fritsch | 24/11 S |
| 3,079,895 | 3/1963 | Gordon | 401/117 X |
| 3,514,211 | 5/1970 | Hashimoto et al. | 401/91 X |
| 3,638,280 | 2/1972 | Di Spirito | 24/11 S |
| 3,740,159 | 6/1973 | Smagala-Romanoff | 401/117 |
| 3,741,665 | 6/1973 | Smagala-Romanoff | 401/117 |

FOREIGN PATENT DOCUMENTS

| | | | |
|---|---|---|---|
| 14868 | of 1904 | United Kingdom | 24/11 F |
| 20224 | of 1910 | United Kingdom | 401/117 |
| 122529 | 1/1919 | United Kingdom | 401/91 |

*Primary Examiner*—Steven A. Bratlie

*Attorney, Agent, or Firm*—Caesar, Rivise, Bernstein & Cohen, Ltd.

[57] ABSTRACT

A cap device for securing an instrument, such as a ball-point pen, to a web of flexible material. The device comprises a stem portion and a body portion which collectively define a first, second and third surface, with the first surface being disposed between the second and third surfaces. The surfaces are disposed in a spaced array to form a longitudinally extending gap which is serpentine in cross section and arranged for receipt of the web of material to bend the web about the surfaces to accomplish a substantially non-traumatic gathering of the web by the device. The device is slidable from a first position wherein it covers the tip of the writing instrument to a second position wherein the tip is exposed. Means are provided to ensure that the device does not slide off the instrument.

8 Claims, 28 Drawing Figures

FIG. 1
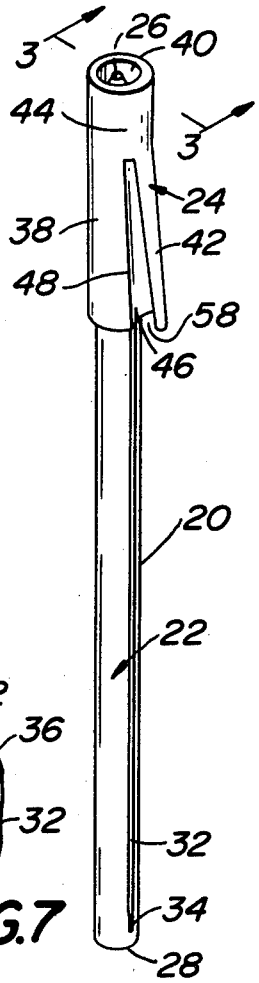
FIG. 2
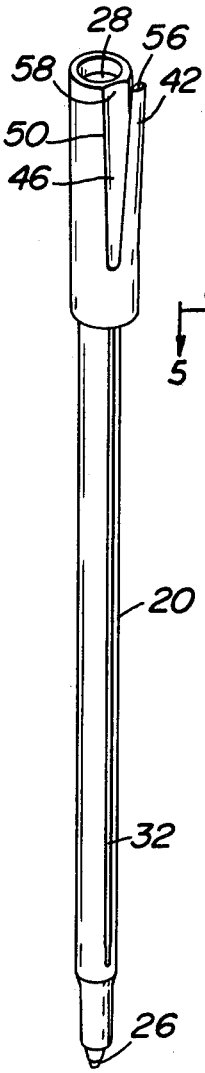
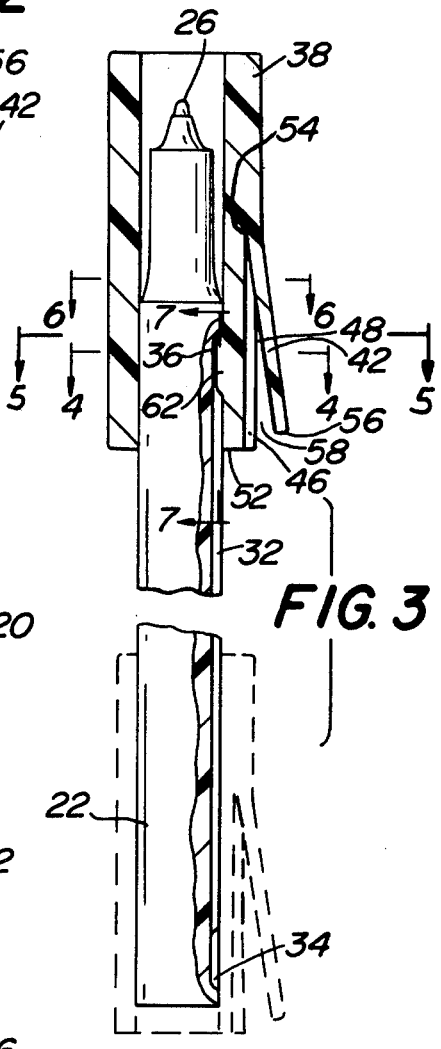
FIG. 3
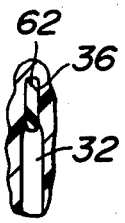
FIG. 7
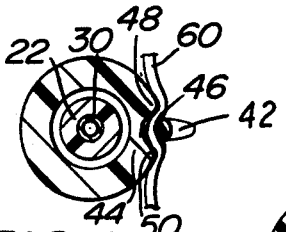
FIG. 6
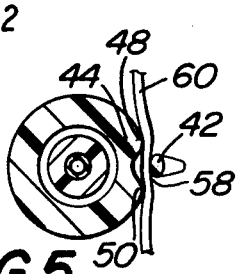
FIG. 5
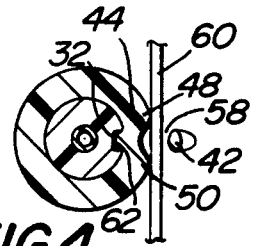
FIG. 4

FIG. 8
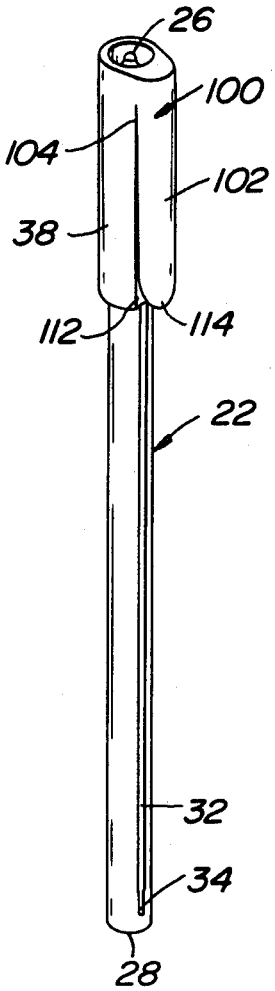
FIG. 9
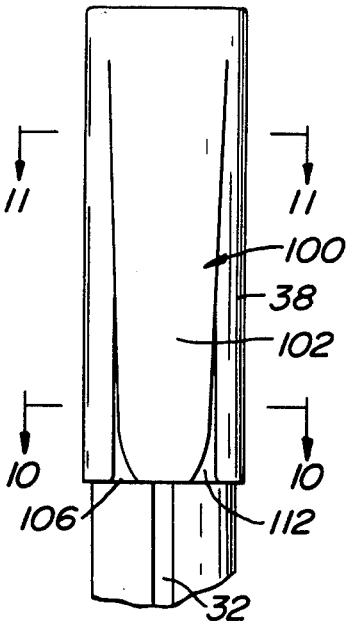
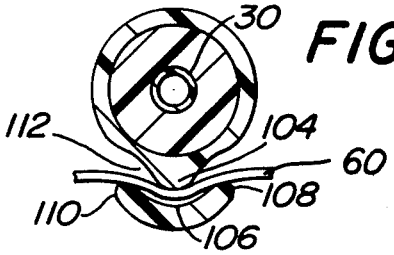
FIG. 10
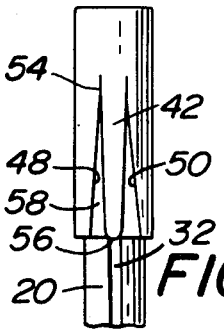
FIG. 7A
FIG. 11
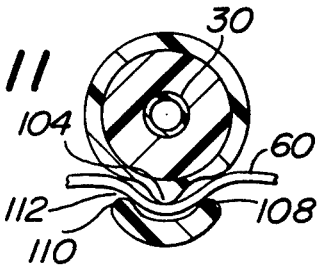

FIG. 16
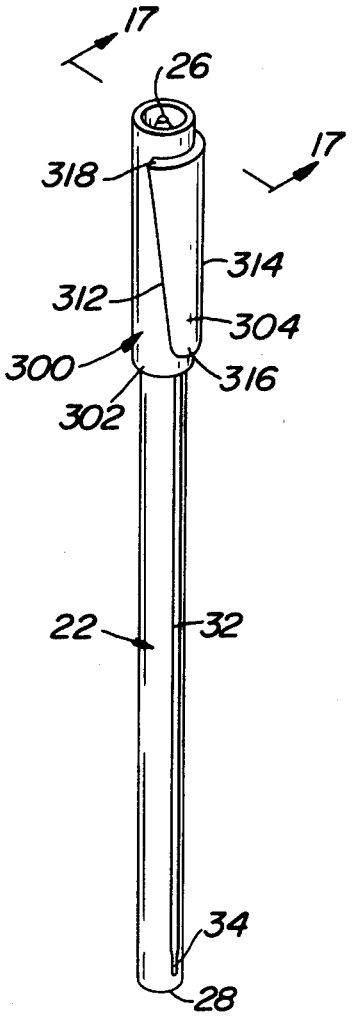
FIG. 17
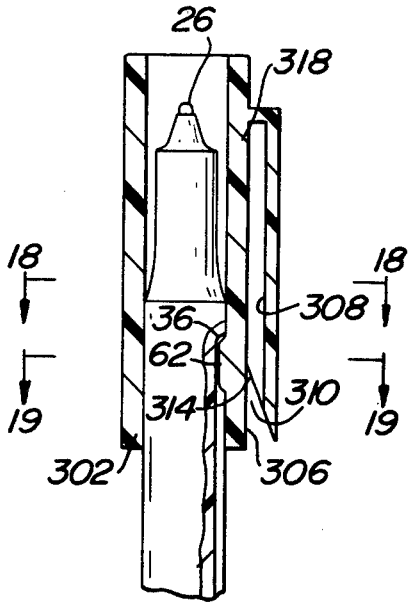
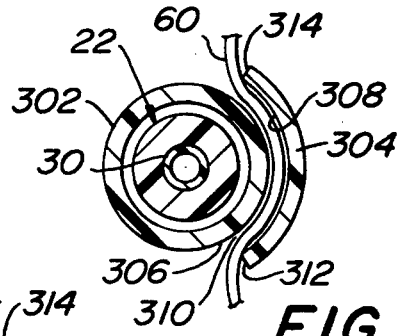
FIG. 18
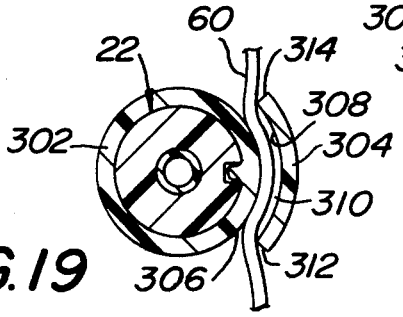
FIG. 19

SLIDING CAP WITH FRICTIONAL ENGAGEMENT

This application is a continuation-in-part of my co-pending U.S. Pat. application Ser. No. 282,299, filed on July 10, 1981, now abandoned and entitled Fasteners For Securing Instruments, whose disclosure is incorporated herein.

This invention relates generally to instruments and, more particularly, to devices for instruments for protecting portions of said instruments and for securing said instruments to a web of material.

Small instruments, such as pens, mechanical pencils, other writing instruments, measuring devices and rulers, flashlights, etc., commonly include a clip for securing the instrument to a web of material, such as the edge of a pocket. Such clips may take many forms and operate in various ways to grasp or pinch the portion of the fabric to hold the instrument in place. For example, some instruments include a metal or plastic clip having a resilient finger or stem and a securing band. The band holds the clip in place on the instrument body, with the stem being disposed generally parallel to the longitudinal axis of the instrument. In other instruments the clip stem forms a portion of a cap. In either construction, the clip typically has a protuberance at the free end of the stem and which is biased into engagement with the instrument body or the cap, as the case may be. To secure the clip to the web of material a portion of the fabric of the material is inserted between the protuberance and the instrument body or cap and into the gap therebetween. This action results in a portion of the fabric between the protuberance and the surface of the instrument or cap being tightly squeezed or clamped and frequently has a traumatic effect on the fabric.

Inexpensive writing instruments, such as ballpoint pens, frequently include an integral cap-clip for disposition on the writing tip of the instrument to cover the tip when not in use. One such pen, sold by Papermate under the trademark WRITE BROS. has a clip including a stem extending longitudinally along the pen body. The inner surface of the stem which is disposed immediately adjacent to the pen body is arcuate in a transverse direction to form a gap for the receipt of the web of material. The thickness of the arcuate gap tapers downward in a longitudinal direction toward the cap itself. Accordingly, fabric located within the gap can be traumatically gripped by deep penetration into the gap.

Commercially available instruments, such as pens, utilizing a cap as the means for securing the instrument to a web of material also exhibit another disadvantage, namely, the tendency of the cap to get lost or misplaced. This disadvantage is the direct result of the fact that prior art instrument caps are not joined or connected in any permanent manner to the instrument, i.e., they are separate units.

A general object of the invention in my aforementioned co-pending patent application is to provide a fastener for instruments which overcomes the disadvantages of the prior art.

A further object of the invention of said co-pending application is to provide a fastener for an instrument which enables the instrument to be secured to a web of material in a substantially non-traumatic manner.

A still further object of the invention of said co-pending application is to provide a fastener for an instrument which is simple in construction and low is cost.

A still further object of the invention of said co-pending application is to provide a combined fastener and cap for a writing instrument which is slidable along the instrument from a position wherein it covers the writing tip to a position wherein the tip is exposed.

Those and other objects of the invention of said co-pending application are achieved by providing a device for securing an instrument to a web of flexible material. The device comprises a first member and a second member which collectively define first, second and third surfaces. The surfaces are disposed in a spaced array with portions thereof defining a serpentine path for collection of the web of said material so that said web is bent about the surfaces to accomplish a substantially non-traumatic gathering of the web by the device.

OBJECTS OF THE INVENTION

It is a general object of the instant invention to provide in an instrument a cap which overcomes the disadvantages of the prior art.

It is still a further object of the instant invention to provide in an instrument a cap for selective positioning over portions of said instrument and which is resistant to loss or misplacement.

It is still a further object of the instant invention to provide an instrument having a cap coupled thereto and which is simple in construction.

These and other objects of the instant invention are achieved by providing an instrument having an elongated body with a first end for performing a function and an oppositely disposed second end. Cap means are coupled to the body and have a recess through which a portion of the instrument body extends. The cap means is slideable along the body from a retracted position wherein it is disposed over and covers the first end by the body and an extended position wherein it is disposed adjacent the second end of the body. The body comprises first engagement means. The cap means includes second engagement means which cooperate with the first engagement means to prevent the cap means from sliding off said body at either end.

Other objects and many of the attendant advantages of the instant invention will become readily apparent by reference to the accompanying drawing wherein:

DESCRIPTION OF DRAWING

FIG. 1 is a perspective view of a writing instrument having a combined fastener and cap constructed in accordance with one aspect of the instant invention;

FIG. 2 is a perspective view of the instrument shown in FIG. 1 with the combined fastener and cap located in a retracted position so that the instrument is ready to write;

FIG. 3 is an enlarged sectional view taken along line 3—3 of FIG. 1;

FIG. 4 is a sectional view taken along line 4—4 of FIG. 3;

FIG. 5 is a sectional view taken along line 5—5 of FIG. 3;

FIG. 6 is a sectional view taken along line 6—6 of FIG. 3;

FIG. 7 is a sectional view taken along line 7—7 of FIG. 3;

FIG. 7A is a front elevational view of a writing instrument having a second embodiment of a combined fastener and cap of the instant invention.

FIG. 8 is a perspective view of a writing instrument including a third embodiment of a combined fastener and cap of the instant invention;

FIG. 9 is an enlarged front elevational view of the combined fastener and cap shown in FIG. 8;

FIG. 10 is a sectional view taken along line 10—10 of FIG. 9;

FIG. 11 is a sectional view taken along line 11—11 of FIG. 9;

FIG. 16 is a perspective view of a writing instrument including a fifth embodiment of a combined fastener and cap of the instant invention;

FIG. 17 is an enlarged sectional view taken along line 17—17 of of FIG. 16;

FIG. 18 is an enlarged sectional view taken along line 18—18 of FIG. 17;

FIG. 19 is an enlarged sectional view taken along line 19—19 of FIG. 17;

DETAILED DESCRIPTION OF THE PREFERRED EMBODIMENT

Figure 12:
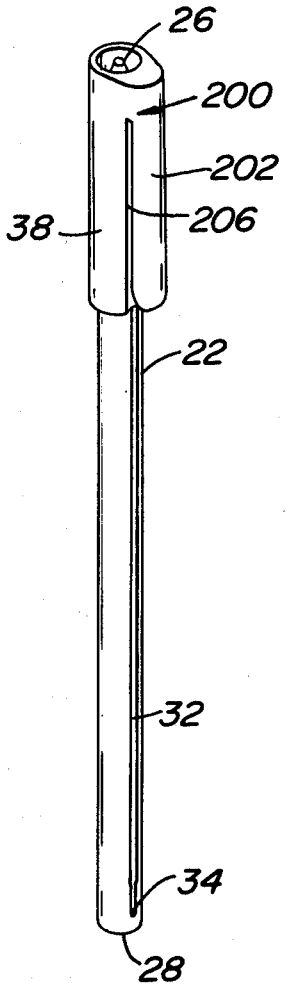
FIG. 12 is a perspective view of a writing instrument including a fourth embodiment of a combined fastener and cap of the instant invention.
Figure 13:
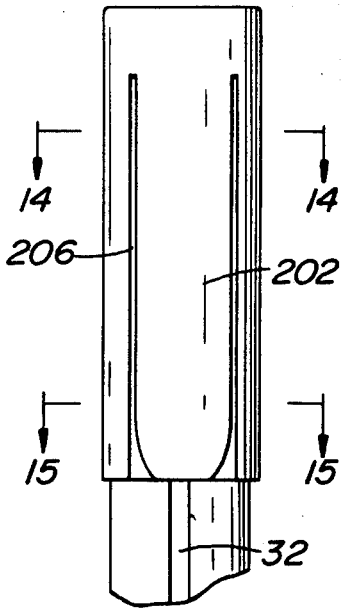
FIG. 13 is an enlarged front elevational view of a portion of the instrument shown in FIG. 12.

Referring now to FIG. 1 wherein like reference characters refer to like parts, there is shown a ballpoint-type pen 20 having a combined fastener and cap constructed in accordance with one embodiment of the instant invention. The pen 20 basically comprises a body portion 22 and the combined fastener and cap 24. The body 22 is an elongated member having a ballpoint tip assembly 26 located at one end. The other end of the body is denoted by the reference numeral 28. The body is tubular, as seen in FIG. 6, and includes a conventional ink supply cylinder or cartridge 30 extending down the center thereof. The ballpoint tip assembly 26 communicates with the ink supply cylinder 30.

An elongated slot 32 extends longitudinally down the body from a narrowed slot portion 34 immediately adjacent end 38 to a similar narrow slot portion 36 (FIG. 3) adjacent the tip 26. The slot 32 will be described in detail later. Suffice for now to say that it cooperates with means on the cap 24 for enabling the cap to be slid longitudinally along the body while precluding it from sliding off.

The cap 24 basically comprises a cylindrical member 38 having a longitudinally extending circular passageway 40 through which the body 22 of the pen 20 may pass as the cap is slid therealong. A finger or stem 42 projects outward at a slight acute angle to the longitudinal axis of the cylindrical member and is disposed in a substantially longitudinal direction with respect to the pen body 22. The stem 42 cooperates with portions of the cap 24 to form a gap, which in cross section is defined by a serpentine path, and into which a portion of a web of fabric or other material is inserted to hold the instrument thereon. As will be appreciated from the following description, the serpentine path insures that frictional engagement is created between the fastener portion of the cap and the web so that the device 20 can be held in place without grabbing or pinching the fabric in a traumatic manner.

As can be seen clearly in FIGS. 4–6, an arcuate groove or recess 46 is provided in the outer surface of the thickened tubular portion 38 of the cap and is disposed immediately opposite the stem 42. The marginal edges 48 and 50 of the recess 46 are in the form of somewhat rounded surface protrusions, each extending along an axis parallel to the longitudinal axis of the pen. The inner surface of the stem 42 disposed immediately adjacent the recess 46 is linear, but rounded in cross section, and is interposed between the surfaces 48 and 50 equadistantly from each at any point therealong.

The free end of the stem 42 is denoted by the reference numeral 56. The space between the inner surface of the stem 42 and the arcuate recess 46 and its marginal edges form a gap 58 for receipt of the web of fabric 60 (FIGS. 4–6) to hold the instrument in place. Since the stem 42 extends at a slight acute angle to the longitudinal axis of the pen 20 and to the surfaces 48 amd 50, the gap 58 tapers downward from the tip 56 of the stem to its root 54.

Referring again to FIGS. 4–6, it can be seen that the gap 58, in cross section, at any point therealong is in the form of a serpentine path, with the path being defined by the space between the inner surface of the stem 42, the marginal surfaces 48 and 50 of the recess 46 and the recess itself.

In accordance with the embodiment shown in FIGS. 1–6, the gap 58 is of substantially greater width at its entrance, that is, at the point contiguous with the free end 56 of the stem, than the thickness of a typical web of fabric onto which the instrument is to be secured. Accordingly, the web of fabric can be readily inserted into the gap 58.

As will be appreciated by those skilled in the art, as the web of fabric is inserted deeper into the gap, the narrowing gap results in the fabric being bent into the serpentine path by the surfaces 48 and 50 of the cap and by the inner surface of the stem 42. The bending of the fabric into the serpentine path does not traumatize the fabric but does create frictional engagement between the fabric and the surfaces forming the serpentine path. The serpentine path is operational to grip the fabric because of the thickness of the fabric and/or the fact that the inside surface of stem 42 is located at or beyond an imaginary line connecting the marginal surfaces 48 and 50. Moreover, when the fabric is inserted sufficiently deep within the gap 58 so that it substantially fills the serpentine path, as shown in FIG. 6, the surfaces forming the serpentine path will have provided sufficient frictional engagement with the fabric to deter the further insertion of the fabric into the gap, which insertion could result in the traumatic clamping or squeezing of the fabric. Furtherstill, the gripping action prevents lateral displacement of the instrument on the web of fabric. Thus, the fastener of the instant invention while providing good gripping action also tends to preclude over-gripping, which action could result in the traumatic pinching of the fabric.

Since the gap 58 has an entrance which is substantially wider than the thickness of a typical web of material but does taper toward its root, the combined fastener cap 24 can accommodate a vast array of different thickness fabrics without substantial traumatic pinching or gripping of such fabrics and can be made to accommodate various sizes.

It must be pointed out at this juncture that the two surfaces 48 and 50 need not be parallel to each other and to the longitudinal axis of the pen. In this regard, the surfaces 48 and 50 can extend at an acute angle to each other and bisected by the longitudinal axis of the pen body, while also being at an acute angle to the axis of the stem. Such a construction is shown in FIG. 7A and permits deeper penetration of the fabric into the gap before filling the serpentine path. Thus, with such an alternative construction, thicker fabrics could be accommodated more readily without increasing the angle of the stem to the axis of the pen body.

It must also be pointed out at this juncture that the gap 58 need not taper downward toward its root as shown in the embodiment of FIGS. 1–6, but can be of uniform width. In this regard, the embodiment shown in FIGS. 12–15 represents such a construction as will be described later. In accordance with another aspect of the instant invention, the cap 24 is permanently mounted on the pen body 22, but is movable from one end to the other to either expose or cover the writing tip. This feature ensures that the cap cannot be misplaced. In FIG. 1, the cap 24 is shown located in its retracted or storage position wherein it is located over the writing tip 26. It is in this position that the pen 20 is arranged to be secured in one's pocket. In FIG. 2, the cap 24 is shown located in an extended position disposed over end 28. It is in the extended position that the pen 20 can be used to write.

A small longitudinally extending projection 62 whose width is substantially equal to the width of the narrowed slot ends 34 and 36 extends radially inward from the inner cylindrical surface of the sidewall 38 of the cap. The projection 62 is located within the longitudinally extending slot 32 in the pen body so that the slot guides the movement of the cap between the retracted and extended position and vice versa. The narrowed slot ends 34 and 36 preclude the cap from sliding off end 28 when the cap is in the extended position, and from sliding off end 26 when the cap is in the retracted position. Moreover, since the width of the slot 32 at the ends 34 and 36 is substantially the same as the width of the projection 62 when the cap is disposed at either end, it is held in place by the frictional engagement of the projection 62 with the respective slotted end. This insures that when the cap is either in the retracted (stored) position or the extended (writing) position, the cap does not slide out of that position unless urged to do so by one's gripping of the cap and pulling it to another position.

In FIG. 8, there is shown an alternative embodiment of the combined fastener and cap of the instant invention shown on the same type of pen body 22 as described with respect to FIG. 1. This alternative embodiment is denoted by the reference numeral 100. Cap 100 is similar in most respects to embodiment 24, except that whereas in cap 24 the inner surface of the stem 42 forms the "intermediate" surface of the serpentine path, in the cap 100 the portion underlying the stem forms the intermediate surface, while the marginal edges of the stem form the outer surfaces. To that end, the cap 100 includes a tubular body portion 38 having a finger or stem 102 projecting outward at a slight acute angle to the longitudinal axis of the pen body 22 and from the root portion 104. The surface of the tubular portion 38 underlying the stem 102 is in the form of a raised arcuate ridge 104 which extends longitudinally down the length of the cap 100. The stem 102 is arcuate in cross section and includes an arcuate inner surface 106 bounded by a pair of rounded marginal edges 108 and 110. The space between the surface of the ridge 104 and the marginal surfaces 108 and 110 defines the gap 112, which like gap 58 of the embodiment of FIG. 1, is serpentine in cross section and tapers downward toward the root 104 of the gap. Thus, as will be appreciated by those skilled in the art, the embodiment 100 operates in an identical manner to the embodiment 24 described heretofore to grip the fabric in a non-traumatic manner.

Figure 14:
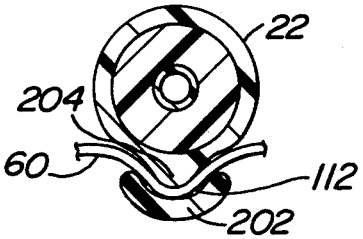
FIG. 14 is a sectional view taken along line 14—14 of FIG. 13.
Figure 15:
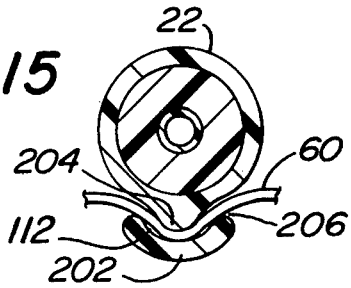
FIG. 15 is a sectional view taken along line 15—15 of FIG. 13.

In FIGS. 12–15, there is shown a pen body 22 having a combined fastener and cap 200 constructed in accordance with the third embodiment of the instant invention. The cap 200 is identical to cap 100 except that the stem 202 extends parallel to the longitudinal axis of the pen body and not at an acute angle thereto. Thus, the gap 206 is of uniform cross sectional size along its entire length as shown in FIGS. 14 and 15.

In FIGS. 16–18 there is shown another pen 22 having a combined fastener and cap 300 constructed in accordance with a fourth embodiment of this invention. The cap 300 includes a tubular member 302 and an integral stem 304. The tubular member has a circular outer surface 306 (FIGS. 18 and 19). The stem is an elongated member which includes an arcuate inner surface 308 congruent with and spaced from the underlying position of the surface 306 to define an arcuate gap 310 therebetween. The side edges 312 and 314 of the stem flare outward from the tip 318 toward the root of the stem. The root 316 is in the form of a flange 318 extending radially outward from the surface 306 of the tubular member 302. Thus, the gap 310 formed between the surfaces 312 and 314 is serpentine in cross section.

Since the marginal edges 312 and 314 extend further around the periphery of the underlying cap surface 306 as one goes deeper into the gap 310 towards its root, the web of fabric 60 is bent through a more severe serpentine path as it extends deeper into the gap. Thus, cap 300 exhibits the same functional characteristics as those exhibited by the embodiments 24 and 100, as described heretofore and can hence be used with a wide variety of different thickness fabrics.

It must be pointed out at this juncture that while the device is shown in the preferred embodiments as being a ballpoint pen, it is clear that the combined fastener and cap of the instant invention can be used with various other small instruments which are adapted to be secured onto a web or fabric or material. Moreover, the device of the instant invention need not even be a combination of a cap and a fastener, but can merely be a fastener constructed to form the serpentine path, via the three spaced surfaces.

Moreover, the fastener can be used with to support any generally planar body, e.g., a painting, photograph, mirror, etc. on a wall surface. In such an arrangement the fastener is secured onto the rear of the body to be supported, with the entrance to its serpentine mouth directed downward for receipt of a strap or bracket formed of a planar web of inflexible material mounted on the wall's surface, but spaced slightly therefrom.

Furtherstill, the fasteners constructed in accordance with this invention may comprise only a stem or projection having the three surfaces. Moreover, the three surfaces forming the serpentine path need not be elongated surfaces and can be small protrusions or teats. Further yet, the three surfaces need not lie in the same plane transverse to the longitudinal axis of the instrument. All that is required for applications in which the instrument is mounted on a flexible fabric web is that the surfaces coact to bend the fabric through a serpentine path wherein a point on the fabric adjacent one surface is always displaced laterally from portions of the fabric adjacent the other surfaces.

As discussed earlier this invention also includes cap means coupled to the instrument for covering the operating end of the instrument, e.g., the pen tip (if the instrument is a ball-point pen), to protect it when it is in the storage position and from moving to an extended position to expose the end when use of the instrument is desired.

Figure 20:
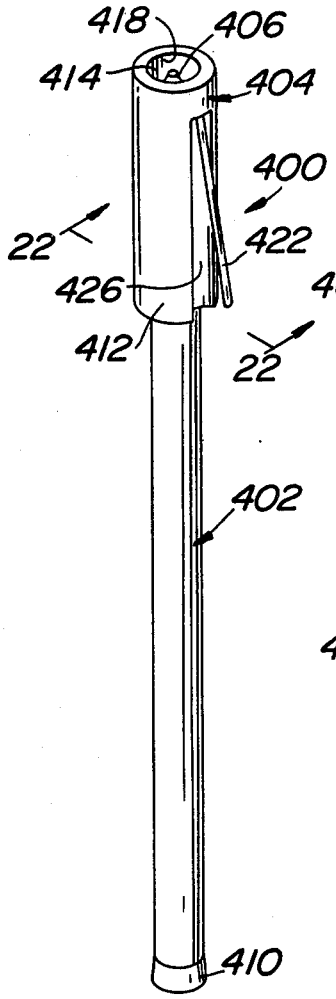
FIG. 20 is a perspective view of a writing instrument including a sixth embodiment of a combined fastener and cap of the instant invention shown in the retracted (stored) position.
Figure 21:
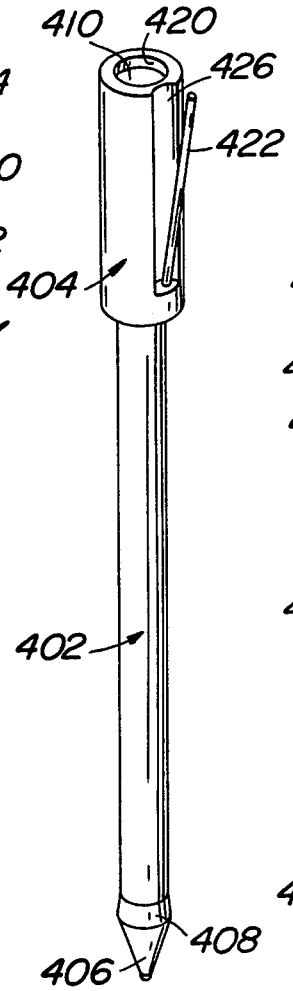
FIG. 21 is a perspective view similar to FIG. 20, but showing the sixth embodiment in the extended (writing) position.
Figure 22:
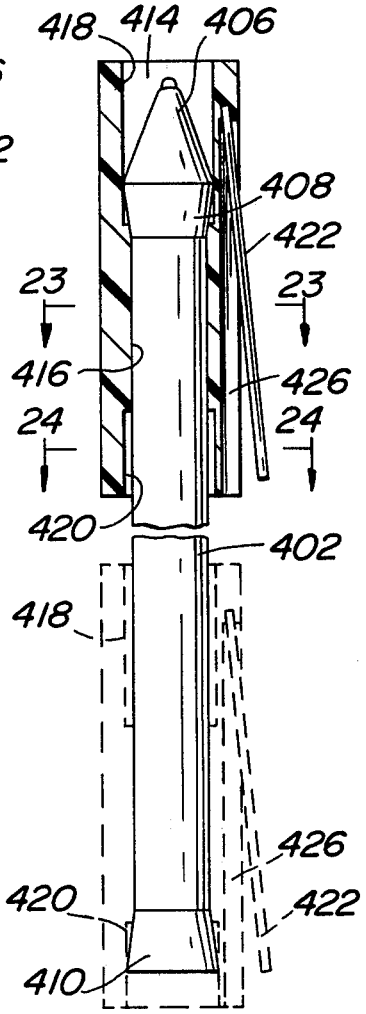
FIG. 22 is an enlarged sectional view taken along line 22—22 of FIG. 20.
Figure 23:
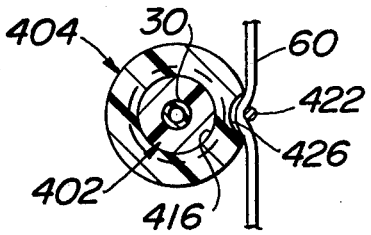
FIG. 23 is a sectional view taken along line 23—23 of FIG. 22.

In FIGS. 20–27 there are shown further alternatives embodiments of the cap aspect of the invention. For example in FIG. 20 a ballpoint-type pen 400 having a combined fastener and cap constructed in accordance with the sixth embodiment of the invention is shown. The pen basically comprises a body portion 402 and the combined fastener and cap 404. The body 402 is an elongated member having a ballpoint tip assembly 406 located at one flared end 408 (FIG. 22). The other end of the body is also flared and it is denoted by the reference numeral 410. The body is of generally conventional construction except for its ends. Suffice for now to say that the ends 408 and 410 serve as stop means which cooperate with surface means on the cap 404 for precluding the cap from sliding off the body and for holding the cap in position over the tip, to protect the tip or in position over the opposite end to expose the tip for use.

The cap 404 basically comprises a cylindrical member 412 having a longitudinally extending circular passageway 414 through which the body of the pen passes as the cap is slid therealong. The passageway 414 includes a reduced diameter central bore 416 and a pair of enlarged diameter end bores 418 and 420. The inside diameter of the central bore is slightly greater than the outside diameter of the body 402 to enable the cap to slide readily therealong. The inner surface of the bore 418 is arranged to cooperate with the flared end 408 of the instrument body by frictionally engaging the latter. Moreover, the wall portion forming the interface of the bore 418 and the central bore 416 precludes the cap from sliding off the body at the tip end while holding the cap fully over the tip to protect it as shown in FIGS. 20 and 22.

The inner surface of the bore 420 operates in a similar manner with the flared stop 410 of the instrument body to hold the cap at the end 410 as shown in the phantom lines in FIG. 22 and in full in FIG. 21, while precluding it from falling off.

Figure 24:
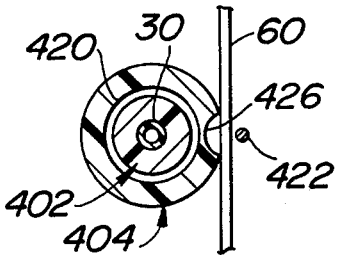
FIG. 24 is a sectional view taken along line 24—24 of FIG. 22.

The cap 404 also includes a finger or stem 422 which projects outwardly at a slight acute angle to the longitudinal axis of the cap and is disposed in a substantial longitudinal direction with respect to the body. The stem 422 cooperates with a longitudinal recess 426 in the surface of the cap 404 to form a gap, which in cross section is defined by a serpentine path. The path is the same as discussed heretofore and is arranged to receive a portion of a web or fabric 46 or other material to hold the instrument thereon, as shown in FIGS. 22 and 24. Thus, serpentine path insures that frictional engagement is created between the cap and the web so that the instrument is held in place safely and without traumatizing the fabric web 60.

Figure 25:
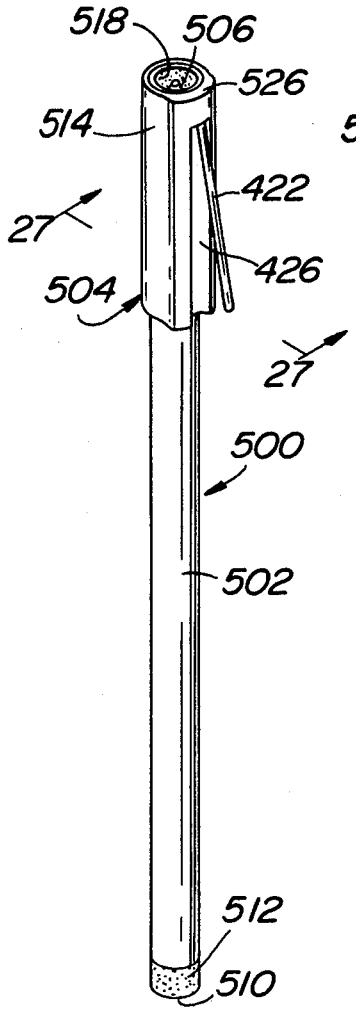
FIG. 25 is a perspective view of a writing instrument including a seventh embodiment of a combined fastener and cap of the instant invention shown in the retracted (stored) position.
Figure 26:
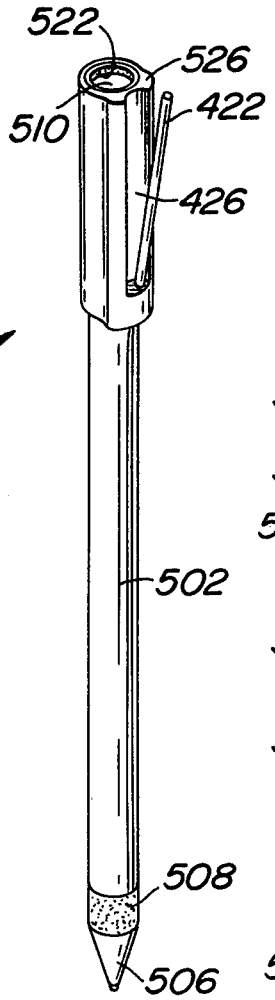
FIG. 26 is a perspective view similar to FIG. 25, but showing the seventh embodiment in the extended (writing) position; and, FIG. 27 is an enlarged sectional view taken along line 27—27 of FIG. 25.
Figure 27:
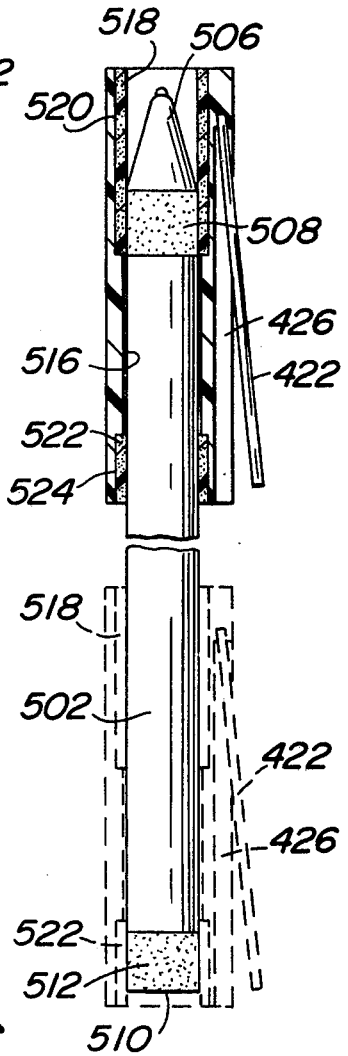

In FIGS. 25–27 there is shown a seventh embodiment of this invention, namely a ballpoint-type pen 500. That pen has a body 502 and a combined fastener and cap 504. The body is constructed similar to body 402 except that it includes a different type of stop means at each end. In this regard a stop means 508, in the form of an annular ring of material having a higher coefficient of friction than the material of the instrument body is disposed about the periphery of the body contiguous with the tip 506. A second annular ring 512 of high frictional material is located at the opposite end 510 of the instrument body. The exterior surface of both rings 508 and 512 is substantially flush with the exterior surface of the instrument body.

The cap 504 basically comprises a cylindrical member 514 having a longitudinally extending circular passageway through which the body of the instrument passes as the cap is slid thereon. The passageway includes an annular ring 518 of a material have a higher coefficient of friction than the material of the cap. The annular ring is located within an annular recess 520 contiguous with the top end of the cap's passageway. A similar annular ring 522 is located within an annular recess 524 contiguous with the bottom end of the passageway of the cap. The inside diameter of each of the rings 518 and 522 is slightly less than or substantially equal to the outside diameter of the rings 508 and 512.

The ring 518 is arranged to cooperate with ring 508 by frictionally engaging it when the cap is slid to the closed position shown in FIGS. 25 and 27. In this position the cap is held in place over the instrument tip 506 while precluding it from sliding off the instrument. The ring 522 cooperates with ring 512 in a similar manner to hold the cap in the extended position shown in full in FIG. 26 and in phantom in FIG. 27.

It must be pointed out at this juncture that the frictional engagement between the cap and the body can be accomplished in various different ways than shown in the drawing. For example, frictional engagement means can be located on either the body or the cap or both body and cap.

Like cap 404, cap 504 includes a finger or stem 422 which projects outwardly at a slight acute angle to the longitudinal axis of the cap and is disposed in a substantially longitudinal direction with respect to the pen body. The stem cooperates with a longitudinally extending recess 426 in the surface of the cap 504 to form a gap which is serpentine in cross section (as described heretofore). Unlike cap 404, the cap 504 is not of uniform wall thickness, (i.e., thickness between the outer and inner surfaces of the cap). Instead, the cap 504 is in the form of a thin-walled tube having a longitudinally extending thickened portion or mesa 526. The longitudinally extending recess 426 is located within the mesa 526.

As will be appreciated from the foregoing, the device of the instant invention is simple in construction, low in cost and yet is effective for securing a instrument or other member to a web of material. Moreover, the device can form a portion of a cap for an insturment (such as a writing instrument) which is resistant to loss or misplacement and which is effective for protecting the operating tip of the instrument when the instrument is not in use and for exposing the operating tip when the instrument is used.

Without further elaboration, the foregoing will so fully illustrate my invention that others may, by applying current or future knowledge, readily adapt the same for use under various conditions of service.

What is claimed as the invention is:

1. An instrument having an elongated body with a first end for performing a function and an oppositely disposed second end, and cylindrical cap means coupled to said body for securing said instrument to a web of material, said cap means having an opening through which a portion of said body extends and slideable along said body between a retracted position, wherein said cap means is disposed over and covers said first end, and an extended positon, wherein said cap means is disposed adjacent said second end, said opening comprising a passageway having an interior surface extending longitudinally through said cap means, first engagement means located on said body, said first engagement means comprising discrete frictional stop surface means in the form of a discrete surface having a higher coefficient of friction than said body located adjacent said first end and a discrete surface having a higher coefficient of friction than said body located adjacent said second end, and wherein each of said discrete surfaces comprises a ring of material extending about the periphery of the body, said cap means including second engagement means, said second engagement means comprising at least one discrete portion of the interior surface of said passageway having a higher coefficient of friction than said body, a discrete surface portion frictionally engaging the discrete surface of the first engagement means adjacent the first end of the body when said cap means is in the retracted position and for engaging the discrete surface of the first engagement means adjacent the second end of the body when said cap means is in the extended position and to disengage from the discrete surfaces of said first engagement means when said cap means is moved between said retracted and extended positions to thereby prevent said cap means from sliding off said body in either the retracted or extended positions while enabling said cap means to be freely slid therebetween.

2. The instrument of claim 1 wherein the surface of each of said rings is substantially flush with the surface of said body.

3. The instrument of claim 1 wherein said cap means includes a device for securing said instrument to a web of flexible material, said device comprising a first member and a second member, said members collectively defining at least first, second and third surfaces, said surfaces being disposed in a spaced array so that portions thereof define a serpentine path for collection of the web of said material so that said web is bent about said surfaces to accomplish a substantially non-traumatic gathering of said web by said device.

4. An instrument having an elongated body with a first end for performing a function and an oppositely disposed second end, and cylindrical cap means coupled to said body for securing said instrument to a web of material, said cap means having an opening through which a portion of said body extends and slideable along said body between a retracted position, wherein said cap means is disposed over and covers said first end, and an extended position, wherein said cap means is disposed adjacent said second end, said opening comprising a passageway having an interior surface extending longitudinally through said cap means, first engagement means located on said body, said first engagement means comprising discrete frictional stop surface means having a higher coefficient of friction than the material of said body, said cap means including second engagement means, said second engagement means comprises a first discrete portion of the interior surface of said passageway adjacent one end thereof and a second discrete portion of the interior surface of said passageway adjacent the opposite end thereof, each of said first and second discrete portions of the interior surface of said passageway having a higher coefficient of friction than said body, one of said first and second discrete surface portions cooperating with said first engagement means to frictionally engage said first engagement means when the said cap means is in said retracted position and the other of said first and second discrete surface portions cooperating with said first engagement means to frictionally engage said first engagement means when the cap means is in said extended position, said first and second discrete surface portions disengaging from said first engagement means when said cap means is moved between said retracted and extended positions to thereby prevent said cap means from sliding off said body in either the retracted or extended positions while enabling said cap meas to be freely slid therebetween.

5. The instrument of claim 4 wherein said discrete frictional stop surface means comprises a ring of material extending about the periphery of said body at each end thereof, the material of each of said rings having a higher coefficient of friction than the remaining portion of said body.

6. The instrument of claim 5 wherein the surface of each of said rings is substantially flush with the surface of said body.

7. The instrument of claim 6 wherein said instrument comprises a writing implement.

8. The instrument of claim 7 werein said implement is a pen.

* * * * *